US012241368B2

(12) United States Patent
Ou et al.

(10) Patent No.: US 12,241,368 B2
(45) Date of Patent: Mar. 4, 2025

(54) SYNCHRONIZATION METHOD FOR AN MWD MUD PULSE TELEMETRY SYSTEM

(71) Applicant: Institute of Geology and Geophysics, Chinese Academy of Sciences, Beijing (CN)

(72) Inventors: Jing Ou, Beijing (CN); Jiansheng Du, Beijing (CN); Wenxiu Zhang, Beijing (CN); Xinzhen He, Beijing (CN); Xiaolong Li, Beijing (CN); Yuliang Wang, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 18/035,294

(22) PCT Filed: Dec. 28, 2020

(86) PCT No.: PCT/CN2020/139834
§ 371 (c)(1),
(2) Date: May 4, 2023

(87) PCT Pub. No.: WO2022/126716
PCT Pub. Date: Jun. 23, 2022

(65) Prior Publication Data

US 2023/0407742 A1 Dec. 21, 2023

(30) Foreign Application Priority Data

Dec. 18, 2020 (CN) ..... 202011513488.X

(51) Int. Cl.
*E21B 47/20* (2012.01)

(52) U.S. Cl.
CPC ..... *E21B 47/20* (2020.05)

(58) Field of Classification Search
CPC ..... E21B 47/12; E21B 47/14; E21B 47/18; E21B 47/20; E21B 47/22; E21B 47/24
See application file for complete search history.

(56) References Cited

U.S. PATENT DOCUMENTS 7,453,768 B2 11/2008 Hall et al.
10,243,725 B2 * 3/2019 Zhao ..... H04L 7/0087
(Continued)

FOREIGN PATENT DOCUMENTS

CN 101202564 6/2008
CN 101778088 7/2010
(Continued)

OTHER PUBLICATIONS

Zheng Jian et al., "Correcting Errors Due to Borehole and Formation Factors during Azimuthal Gamma Spectrum Logging While Drilling", Petroleum Drilling Techniques, Jan. 2020, submit with English abstract, pp. 104-113.
(Continued)

*Primary Examiner* — Franklin D Balseca
(74) *Attorney, Agent, or Firm* — Li & Cai Intellectual Property Office

(57) ABSTRACT

Disclosed is a synchronization method for an MWD mud pulse telemetry system. The method comprises: determining a synchronous training sequence on the basis of a frame structure of downhole sent data; constructing a correlation between the down-hole sending synchronous training sequence waveform and the uphole synchronous training sequence local waveform by means of the irrelevance of the trigonometric function; and performing correlation calculation on the synchronous training codeword waveform, which is received uphole and is subjected to the first modulation, and the synchronous training sequence local waveform, which is subjected to the second modulation, so
(Continued)

as to obtain a correlation curve, and finding a synchronous position by means of the correlation curve.

8 Claims, 7 Drawing Sheets

(56) References Cited

U.S. PATENT DOCUMENTS

| | | | | |
|---|---|---|---|---|
| 11,066,928 | B2 * | 7/2021 | Raveloson | E21B 47/12 |
| 2011/0309948 | A1 | 12/2011 | Montgomery et al. | |
| 2012/0163523 | A1 | 6/2012 | Tang | |
| 2015/0177042 | A1 | 6/2015 | Song et al. | |
| 2019/0052374 | A1 * | 2/2019 | Lie | H04B 17/345 |

FOREIGN PATENT DOCUMENTS

| | | |
|---|---|---|
| CN | 102134991 | 7/2011 |
| CN | 103806892 | 5/2014 |
| CN | 105306077 | 2/2016 |
| CN | 106199719 | 12/2016 |
| CN | 106850477 | 6/2017 |
| CN | 109611075 | 4/2019 |
| CN | 110770413 | 2/2020 |

OTHER PUBLICATIONS

"International Search Report (Form PCT/ISA/210) of PCT/CN2020/139834," mailed on Sep. 17, 2021, with English translation thereof, pp. 1-6.

"Written Opinion of the International Searching Authority (Form PCT/ISA/237) of PCT/CN2020/139834," mailed on Sep. 17, 2021, pp. 1-4.

"Office Action of China Counterpart Application", issued on Jul. 9, 2021, with English translation thereof, pp. 1-12.

* cited by examiner

SYNCHRONIZATION METHOD FOR AN MWD MUD PULSE TELEMETRY SYSTEM

CROSS-REFERENCE TO RELATED APPLICATION

This application is a 371 of international application of PCT application serial no. PCT/CN2020/139834, filed on Dec. 28, 2020, which claims the priority benefit of China application no. 202011513488.X, filed on Dec. 18, 2020. The entirety of each of the above mentioned patent applications is hereby incorporated by reference herein and made a part of this specification.

TECHNICAL FIELD

The present invention relates to the technical field of MWD (Measure While Drilling) systems, and more particularly to a synchronization method for an MWD mud pulse telemetry system.

BACKGROUND ART

In recent years, in order to further improve the well drilling efficiency, the real-time logging information, such as the orientation, formation characteristics, well drilling parameters, etc. that need to be transmitted by an MWD mud pulse telemetry system, shows explosive growth. The low transmission rate of the traditional positive and negative pulse transmission system has become the bottleneck problem restricting the development of MWD mud pulse telemetry system. In order to meet the increasing demand for information, the technology of using a shear valve to realize mud continuous wave has emerged, which improves the data transmission rate of the MWD mud pulse telemetry system and has gradually become a promising technology.

The MWD mud continuous wave telemetry system achieves the interception effect of the mud through the continuous motion of an electric motor rotor, and forms a continuous pressure wave. The oscillation frequency of the rotor of the rotary valve of the electric motor can reach and the carrier modulation is carried out by using various modulation modes such as ASK (Amplitude-Shift Keying), FSK (Frequency-shift keying), and PSK (Phase-shift keying), so that the transmission rate can reach 40 bps. Compared with the maximum transmission rate of 5 bps of the positive and negative pulse transmission system, the MWD mud continuous wave system can meet the increasing demand for downhole data transmission. Further, downhole image transmission may be accomplished in conjunction with techniques such as data compression.

In the MWD mud continuous wave system, how to accurately perform synchronizing is one of the important technologies to ensure the high-speed transmission of the system. Currently, the MWD mud continuous wave system synchronizes, at the downhole by inserting a fixed synchronous training codeword at the beginning of the data frame, and looking for a peak of the correlation result of the received waveform and the local waveform of the synchronous training sequence.

In practical applications, due to the poor correlation of the synchronous training codeword based on FSK modulation, problems such as poor synchronization accuracy, high bit error rate, poor anti-noise capacity, and shallow transmission depth of the system are caused. The above drawback restricts the use and development of the MWD mud continuous wave telemetry system on the basis of FSK modulation. Currently, there is no effective solution to this problem.

Therefore, there is an urgent need for an improvement on synchronization performance for the MWD system based on FSK modulation.

SUMMARY OF THE INVENTION

It is an object of the present invention to provide a synchronization method for an MWD mud pulse telemetry system, which solves the above-mentioned problem in the prior art so as to improve the synchronization accuracy, thereby reducing the bit error rate.

The present invention provides a synchronization method for the MWD mud pulse telemetry system, comprising the following steps:

- determining a synchronous training sequence on the basis of a frame structure of downhole sent data;
- constructing a correlation between the downhole sending synchronous training sequence waveform and the uphole synchronous training sequence local waveform by means of the irrelevance of the trigonometric function;
- performing, uphole, correlation calculation on the received first modulation signal waveform and the synchronous training sequence local waveform, which is subjected to the second modulation, so as to obtain a correlation curve; and finding a synchronous position according to the peak of the correlation curve.

In the synchronization method for the MWD mud pulse telemetry system as mentioned above, preferably, determining a synchronous training sequence on the basis of a frame structure of downhole sent data specifically comprises:

- determining the frame structure of the downhole sent data;
- determining a synchronous training sequence according to the frame structure of sent data;
- and sending the synchronous training sequence subjected to the first modulation through a shear valve.

In the synchronization method for the MWD mud pulse telemetry system as mentioned above, preferably, performing, uphole, correlation calculation on the received signal waveform which is subjected to the first modulation and the synchronous training sequence local waveform which is subjected to the second modulation, so as to obtain a correlation curve specifically comprises:

- sending the synchronization sequence subjected to the first modulation through a shear valve; and
- in the uphole, collecting the above-mentioned signal via a pressure sensor and performing correlation calculation on the same with the synchronization sequence local waveform of the second modulation so as to obtain a correlation curve.

In the synchronization method for the MWD mud pulse telemetry system as mentioned above, preferably, constructing a correlation between the downhole sending synchronous training sequence waveform and the uphole synchronous training sequence local waveform by means of the irrelevance of the trigonometric function specifically comprises:

- sending FSK modulated synchronous training codeword downhole and using OOK modulated local waveform uphole.

In the synchronization method for the MWD mud pulse telemetry system as mentioned above, preferably, constructing a correlation between the downhole sending synchronous training sequence waveform and the uphole synchronous training sequence local waveform by means of the irrelevance of the trigonometric function specifically comprises: sending OOK modulated synchronous training codeword downhole and using FSK modulated local waveform uphole.

In the synchronization method for the MWD mud pulse telemetry system as mentioned above, preferably, finding a synchronous position according to the peak of the correlation curve specifically comprises: taking a position of the peak in the correlation curve as a result of a synchronization output.

In the synchronization method for the MWD mud pulse telemetry system as mentioned above, preferably, prior to synchronization, the method further comprises:

steps of downhole coding and modulation, mud continuous wave channel attenuation and interference on the useful signal, uphole denoising, and uphole matched filtering which are implemented in sequence.

In the synchronization method for the MWD mud pulse telemetry system as mentioned above, preferably, after constructing a correlation between the downhole sending synchronous training sequence waveform and the uphole synchronous training sequence local waveform by means of the irrelevance of the trigonometric function, the method further comprises:

steps of uphole equalization, uphole demodulation, and decoding which are implemented in sequence.

According to the synchronization method for the MWD mud pulse telemetry system provided by the present invention, a synchronous training sequence is constructed, and the improvement of the synchronization method for the MWD mud pulse telemetry system based on FSK modulation is provided on the basis of the above synchronous sequence; downhole and uphole synchronization of above system is completed, such that the correlation peak of the correlation curve is increased, and the difference between the main peak and the sub-peak is increased; according to the present invention, the synchronization accuracy and reliability of the MWD mud pulse telemetry system are improved while not increasing the complexity of controlling the electric motor of the MWD mud pulse telemetry system; at the same time, the synchronous training sequence can also be used as a fixed codeword for equalizer learning.

BRIEF DESCRIPTION OF THE DRAWINGS

In order to make the objects, aspects, and advantages of the present invention clearer, the present invention will be further described below in conjunction with the accompanying drawings, in which.

DETAILED DESCRIPTION OF THE INVENTION

Various exemplary embodiments of the present disclosure will now be described in detail with reference to the accompanying drawings. The description of exemplary embodiments is merely illustrative and is in no way intended to limit the present disclosure, and applications or uses thereof. The present disclosure may be implemented in many different forms and should not be limited to the embodiments set forth herein. These embodiments are provided so that the present disclosure will be thorough and complete, and will fully convey the scope of the disclosure to those skilled in the art. It should be noted that: the relative arrangement of the components and steps, the components of the material, and the numerical expressions and values set forth in these embodiments are to be construed as merely illustrative, and not limitative, unless otherwise specifically specified.

The "first", "second", and similar words used in the present disclosure do not denote any order, quantity or importance, but are only used to distinguish different parts. Similar words such as "including" or "comprising" mean that the elements before the word cover the elements listed after the word, and do not exclude the possibility of covering other elements. "Up", "down", etc. are only used to represent the relative positional relationship. When the absolute position of the described object changes, the relative positional relationship may also change accordingly.

All terms (including technical or scientific terms) used in this disclosure have the same meaning as commonly understood by one of ordinary skill in the art to which this disclosure belongs, unless otherwise specifically defined. It should be further understood that terms, such as those defined in commonly used dictionaries, should be interpreted as having a meaning that is consistent with their meanings in the context of the relevant art and should not be interpreted in an idealized or overly formalize unless expressly so defined herein.

Techniques, methods, and devices known to those of ordinary skill in the relevant art may not be discussed in detail, but the techniques, methods, and devices should be considered part of the description where appropriate.

Figure 1:
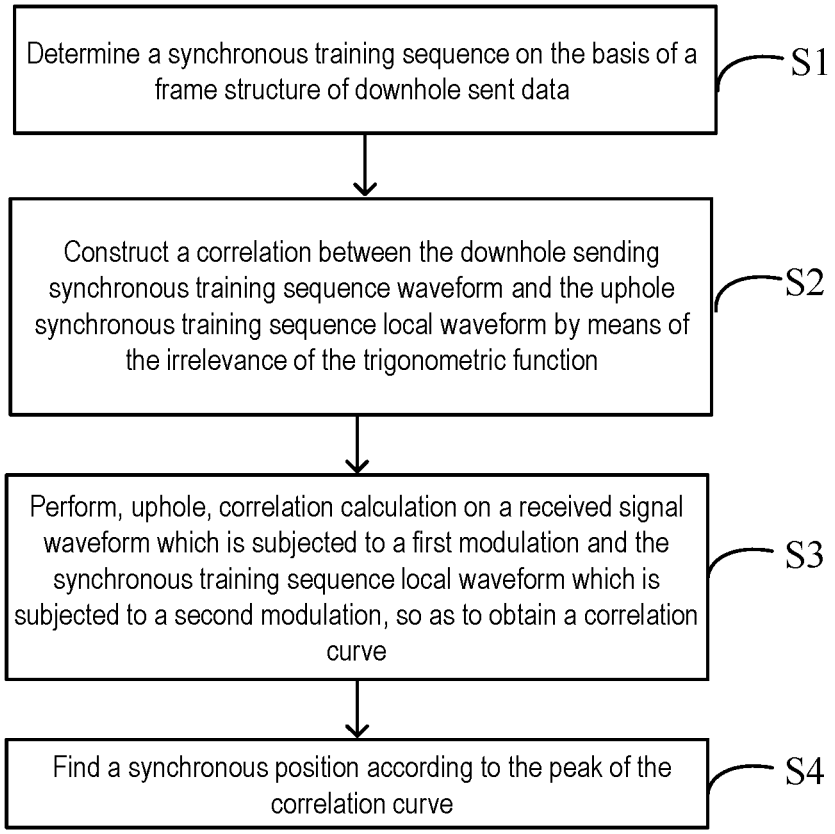
FIG. 1 is a flow diagram of an embodiment of a synchronization method for an MWD mud pulse telemetry system provided by the present invention.

As shown in FIG. 1, a synchronization method for an MWD mud pulse telemetry system provided in the present embodiment specifically comprises the following steps in the actual execution process:

step S1, determining a synchronous training sequence on the basis of the frame structure of downhole sent data.

Wherein the synchronous training sequence subjected to the first modulation is determined on the basis of the frame structure of the downhole sent data. In one implementation mode of the synchronization method for the MWD mud pulse telemetry system of the present invention, step S1 may specifically comprise:

step S11, determining the frame structure of the downhole sent data;

and step S12, determining a synchronous training sequence according to the frame structure of the sent data.

Specifically, in order to meet the requirement of high synchronization accuracy, it is necessary to make the synchronous training sequence have good autocorrelation characteristics, namely, the correlation peak in the correlation curve is sharp, which reflects the high synchronization accuracy of the synchronous training sequence; furthermore, in order to meet the requirements of strong anti-interference capability, it is necessary to make the sub-peak interference in the correlation curve of synchronous training sequence low, i.e. the amplitude of sub-peak is far less than the main peak and the location of sub-peak is far away from the main peak, which reflects the strong anti-interference capability of the synchronous training sequence.

Step S13, send the synchronous training sequence subjected to the first modulation through a shear valve.

Figure 2:
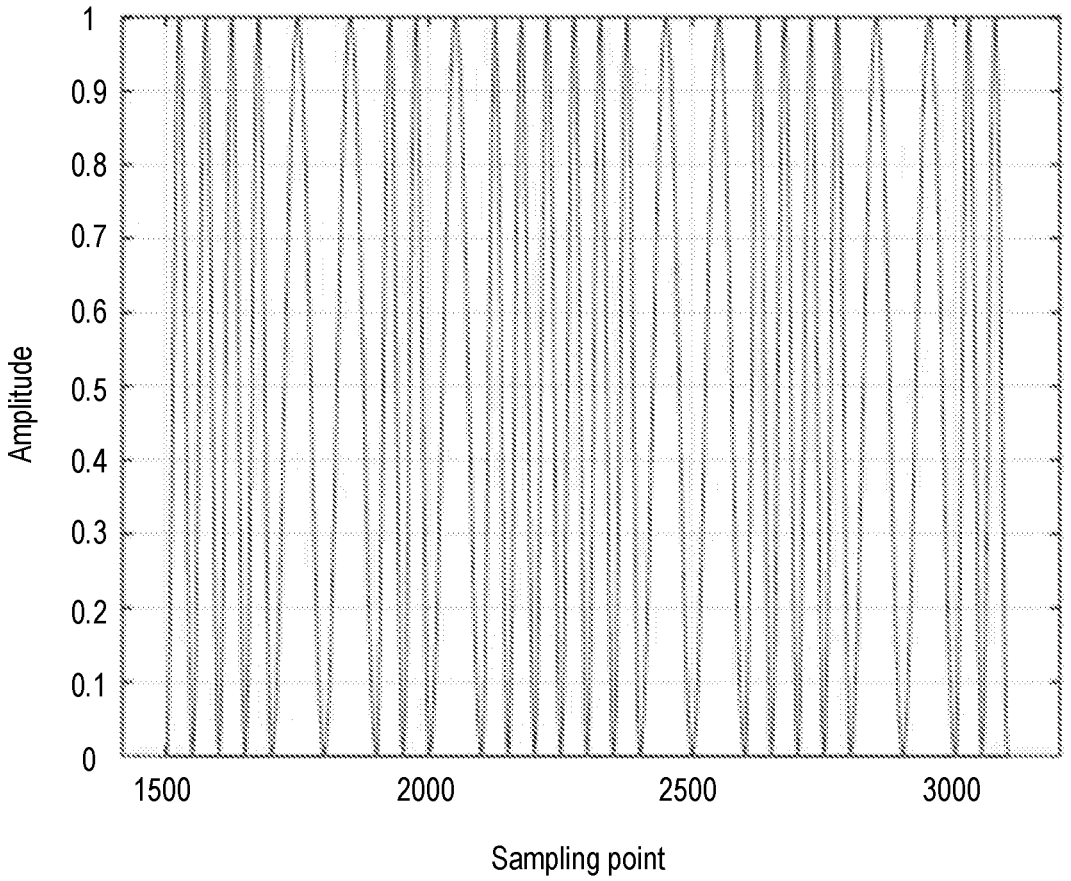
FIG. 2 is the FSK modulated synchronous training sequence time domain waveform, where 10 Hz represents a "0" codeword and 20 Hz represents a "1" codeword.

The synchronous training sequence may specifically be subjected to FSK modulation or ASK modulation or PSK modulation. At present, due to the long signal transmission distance and large signal amplitude attenuation in the field of petroleum drilling, OOK (On-Off Keying) modulation is commonly used for ASK modulation. At present, the commonly used synchronous training codewords include m-sequence, M-sequence, Gold sequence, etc. However, the synchronization performance of the existing codewords in the MWD mud pulse telemetry system on the basis of FSK modulation is poor: mis-synchronization tends to occur when SNR is low, resulting in decoding error. The time domain waveform of the synchronous training sequence subjected to FSK modulation designed by the present invention is shown in FIG. 2, where the carrier frequency is 10 Hz and 20 Hz, the sampling frequency is 1 KHz, the data rate is 10 bps, and the synchronization sequence starting position is at the 1.5 s (the 1501th sampling point).

Figure 3:
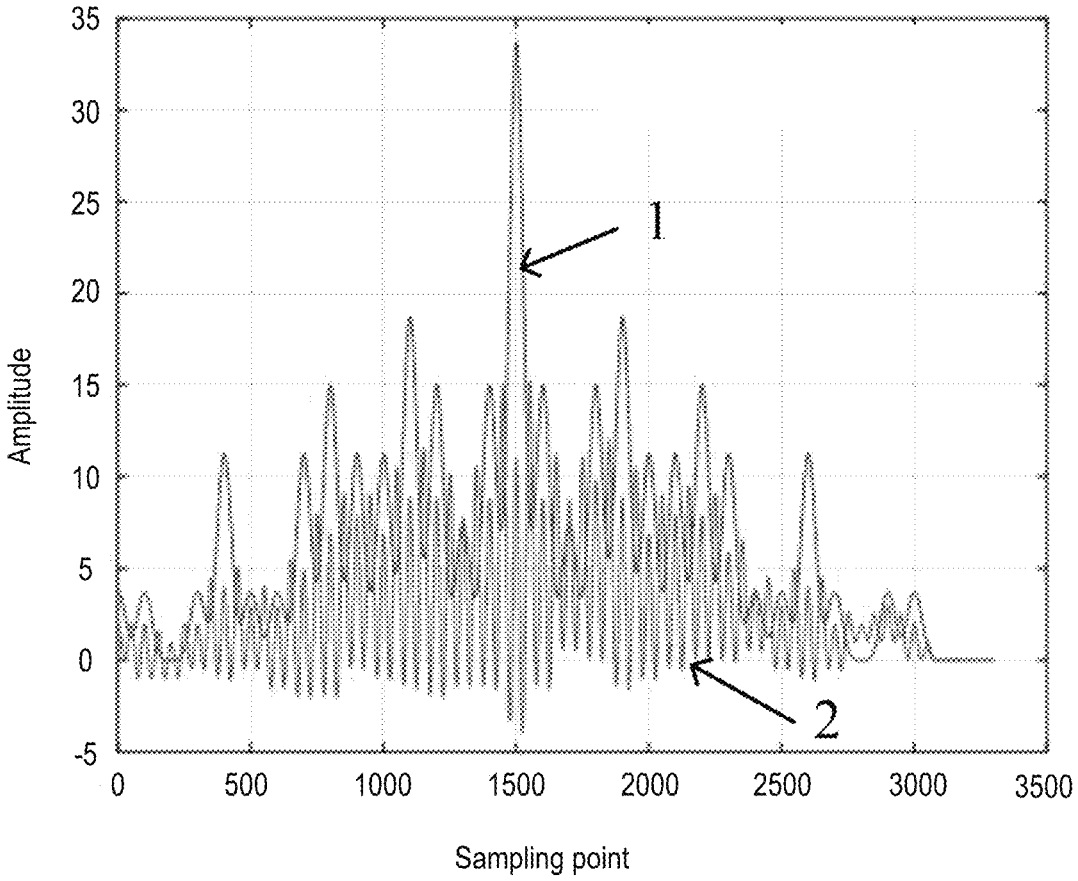
FIG. 3 is the correlation curve comparison of the waveform of the current synchronous training sequence based on OOK modulation and FSK modulation with the local waveform with the same modulation when there is no noise.

Specifically, in the absence of noise, a correlation calculation is performed on the synchronous training sequence based on OOK modulation and FSK modulation, respectively, resulting in the first correlation curve (curve 1) and the second correlation curve (curve 2), respectively, as shown in FIG. 3.

It can be seen from FIG. 3 that when there is no noise, the main peak of the correlation curve of the synchronous training sequence based on OOK modulation is about 4.9 dB higher than the peak of the correlation curve based on FSK modulation. At the same time, the amplitude difference between the sub-peak and the main peak is greater and the distance is farther. At this time, the output of the synchronous training sequence at the synchronous sampling point based on OOK modulation is 1501 and at a synchronous sampling point based on FSK modulation is 1552, and the errors are 0 sampling point and 51 sampling points, respectively, namely, 0 ms and 51 ms. At this time, the FSK modulation system will mis-synchronize to the sub-peak of the correlation curve, resulting in a system mis-synchronization of 0.5 code element periods so that an increased bit error rate for the entire data frame is caused.

In summary, the synchronization performance of the synchronous training sequence based on OOK modulation is superior to the synchronization performance based on FSK modulation: the correlation peak is sharper, namely, the synchronization performance of the synchronous training sequence based on OOK modulation is better; the sub-peak interference is low, namely, the anti-interference performance of the synchronous training sequence based on OOK modulation is better.

Further, gaussian white noise is added to the mud pulse telemetry signal based on OOK modulation and FSK modulation respectively.

Because the mud channel is affected by pump noise, motor noise, vibration noise and so on, the channel condition is poor. At the same time, as the well depth increases, the attenuation of mud continuous wave rises rapidly. Both of the factors result in a low SNR of the useful signal received at the ground, which is about 1 dB.

Figure 4:
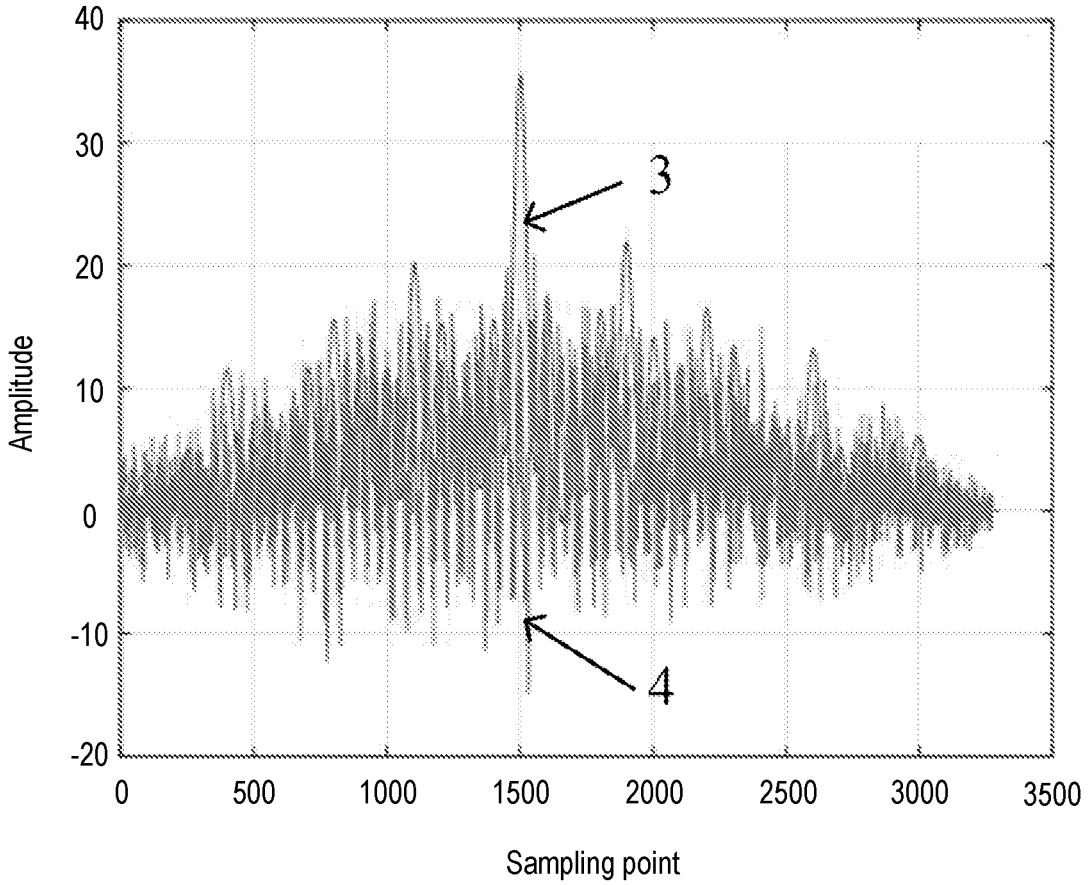
FIG. 4 is the correlation curve comparison of the waveform of the current synchronous training sequence based on OOK modulation and FSK modulation with the local waveform with the same modulation when SNR is 1 dB.

Gaussian white noise is added to the mud pulse telemetry signal based on OOK modulation and FSK modulation, and correlation calculation is performed on the above signals with their synchronous training sequences respectively, so as to obtain the third correlation curve (curve 4) and the fourth correlation curve (curve 5) as shown in FIG. 4.

It can be seen from FIG. 4 that the main peak of the correlation curve of the synchronous training sequence based on OOK modulation is still higher than the main peak of the correlation curve based on FSK modulation. The output of the synchronous training sequence at a synchronous sampling point based on OOK modulation is 1501 and at a synchronous sampling point based on FSK modulation is 1554, and the errors are 0 sampling point and 53 sampling points, respectively, namely, 0 ms and 53 ms. At this time, the FSK modulation system will mis-synchronize to the sub-peak of the correlation curve, resulting in a system mis-synchronization of code element periods so that an increased bit error rate for the entire data frame is caused.

In summary, when SNR is 1 dB, the synchronization performance of the synchronous training sequence based on OOK modulation system is superior to the synchronization performance based on FSK modulation: the correlation peak is sharper, namely, the synchronization performance of the synchronous training sequence based on OOK modulation system is better; the sub-peak interference is low, namely, the anti-interference performance of the synchronous training sequence in the OOK modulation system is better.

Step S2, construct a correlation between a downhole sending synchronous training sequence waveform and an uphole synchronous training sequence local waveform by means of the irrelevance of the trigonometric function.

In order to solve the problems such as high bit error rate, poor anti-noise capability, and shallow transmission depth caused by the poor synchronization accuracy of the synchronous training sequence based on FSK modulation, the present invention proposes to use synchronous training sequence modulated by OOK as sending waveform or local synchronous waveform in the MWD mud continuous wave system on the basis of FSK modulation.

Using the orthogonality of the trigonometric function $e^{j2\pi kf_c t}$, k∈N, we can obtain:

$$\int \cos(1\pi l f_c t)\times\cos(2\pi m f_c t)dt=0, l\neq m, l\in N, m\in N \quad (1)$$

Wherein $f_c$ represents the carrier frequency, in particular, when l=0, $$\int 1\times\cos(2\pi m f_c t)dt=0, m\in N^{-} \quad (2)$$

It can be seen from the above-mentioned properties of the trigonometric function that when a sine wave is used as a carrier signal, each frequency doubling of the carrier frequency $f_c$ is irrelevant. Therefore, in the correlation algorithm, the frequency being equal to zero and the frequency being equal to $n \times f_c, n \neq 1$ are equivalent, and both of them are uncorrelated with the signal whose frequency is equal to $f_c$. At the same time, signals of the frequency being equal to zero and the frequency being equal to $n \times f_c, n \neq 1$ are mutually uncorrelated.

Specifically, on the basis of the orthogonality of the above-mentioned trigonometric function, there are two technical solutions in step S3. In one implementation mode of the present invention, a synchronous training codeword based on FSK modulation is sent downhole, and a local waveform based on OOK modulation is used uphole. In another implementation mode of the invention, a synchronous training codeword based on OOK modulation is sent downhole and the local waveform based on FSK modulation is used uphole.

To satisfy the orthogonality, the present invention requires that the carrier frequency of the downhole FSK modulated "1" codeword be designed to be the same as the carrier frequency of the uphole OOK modulated local synchronous training "1" codeword, or that the carrier frequencies of the "0" codeword are the same downhole and uphole.

Figure 5:
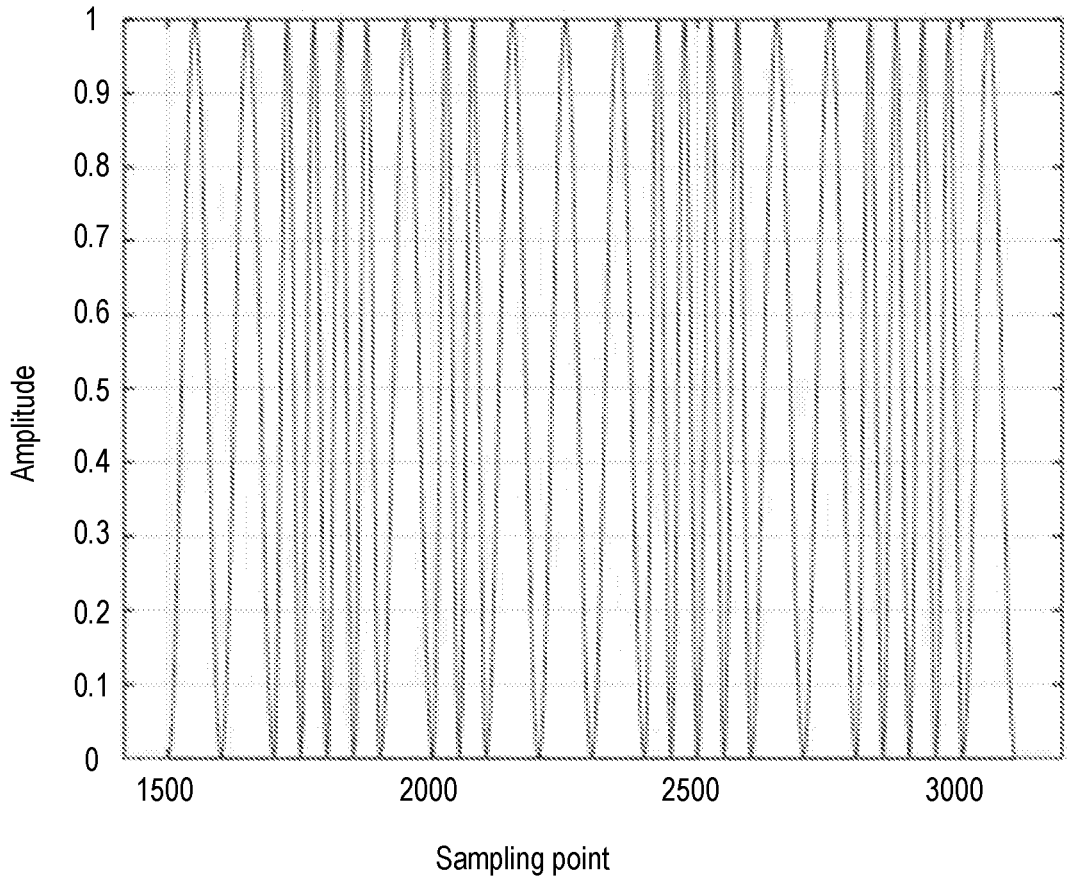
FIG. 5 is the time domain waveform of the synchronous training sequence subjected to FSK modulation, where 20 Hz represents a "0" codeword and 10 Hz represents a "1" codeword.

Specifically, taking the former as an example, when the FSK modulated waveform occurs downhole, 20 Hz is used to represent a "0" codeword and 10 Hz is used to represent a "1" codeword, as shown in FIG. 5. The uphole OOK modulated synchronous training sequence uses 0 Hz to represent "0" codeword and 10 Hz to represent "1" codeword. At this time, the waveforms of "1" codewords downhole and uphole are the same, and the "0" codewords and the "1" codewords are orthogonal. At the same time, "0" codewords downhole and uphole are orthogonal to each other.

In a specific implementation, in order to solve the problem of poor synchronization performance of a synchronous training codeword based on FSK modulation, and at the same time ensure that the complexity of electric motor control is not increased and the synchronous training sequence can be used as a function for an equalizer to learn a fixed codeword, the present invention uses the following solution: sending, downhole, a synchronous training codeword waveform modulated by FSK and using, uphole, a local waveform modulated by OOK for synchronization.

Step S3, perform correlation calculation on the synchronous training codeword waveform, which is received uphole and is subjected to the first modulation, and the synchronous training sequence waveform, which is subjected to the second modulation, so as to obtain the correlation curve.

In a particular implementation, perform, uphole, correlation calculation on the received first modulation signal waveform and the synchronous training sequence local waveform, which is subjected to the second modulation, so as to obtain the correlation curve.

Figure 6:
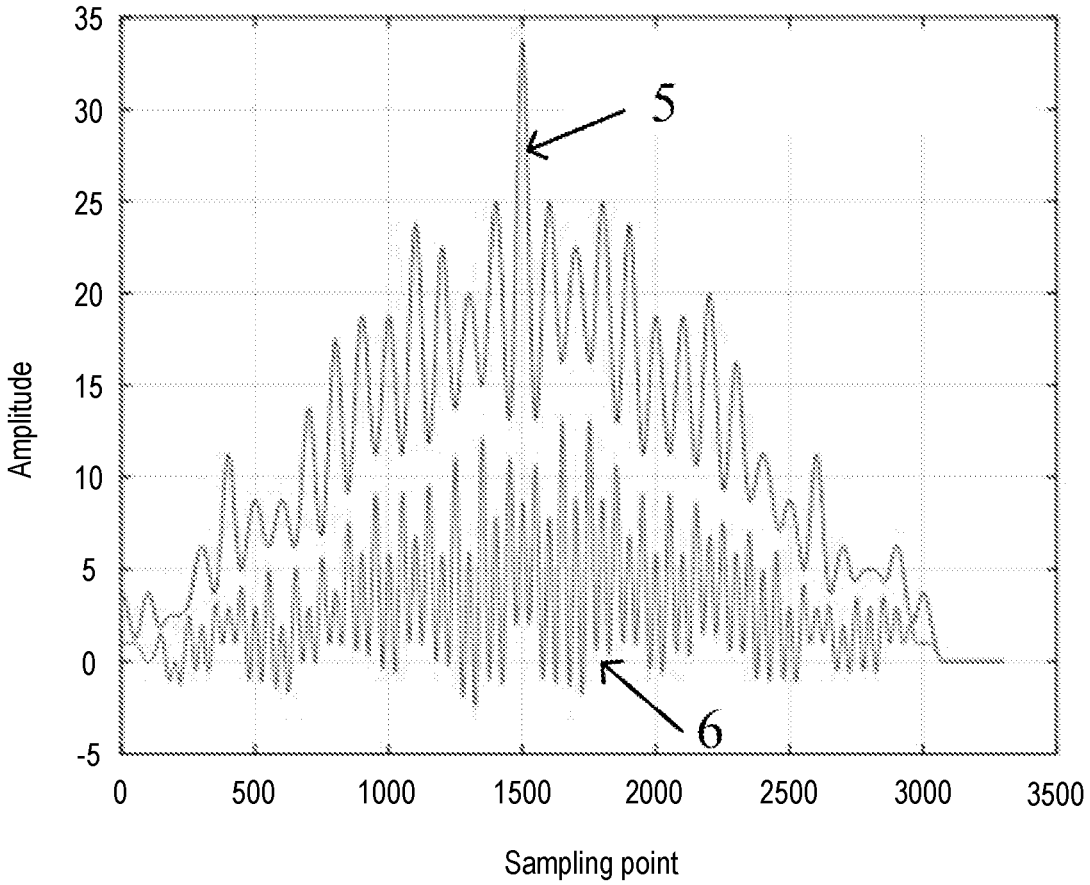
FIG. 6 is a graph comparing curves of the FSK modulated training sequence waveforms respectively related to the synchronous training sequence local waveforms subjected to OOK modulation and FSK modulation when there is no noise.

It can be seen from FIG. 6 that when no noise is presented and the FSK modulated synchronous training sequence waveform is sent downhole, the main peak of the correlation curve (curve 5) when the OOK modulated waveform is used uphole as the local waveform is about 5.9 dB higher than the correlation curve (curve 6) when the FSK modulated waveform is used uphole as the local waveform. At this time, the output of the synchronous sampling point of the former is 1501, the output of the synchronous sampling point of the latter is 1650, and the errors are 0 sampling point and 149 sampling points, respectively, i.e. 0 ms and 149 ms. In this case, the local waveform of the synchronous training sequence modulated by FSK will be mis-synchronized to the sub-peak of the correlation curve, resulting in a synchronization error of 1.5 code element periods so as to cause an increased bit error rate of the whole data frame. Therefore, the present invention greatly improves the synchronization accuracy of the MWD mud pulse telemetry system on the basis of FSK modulation, thereby solving the problem of increased bit error rate due to the synchronization in the original system.

Figure 7:
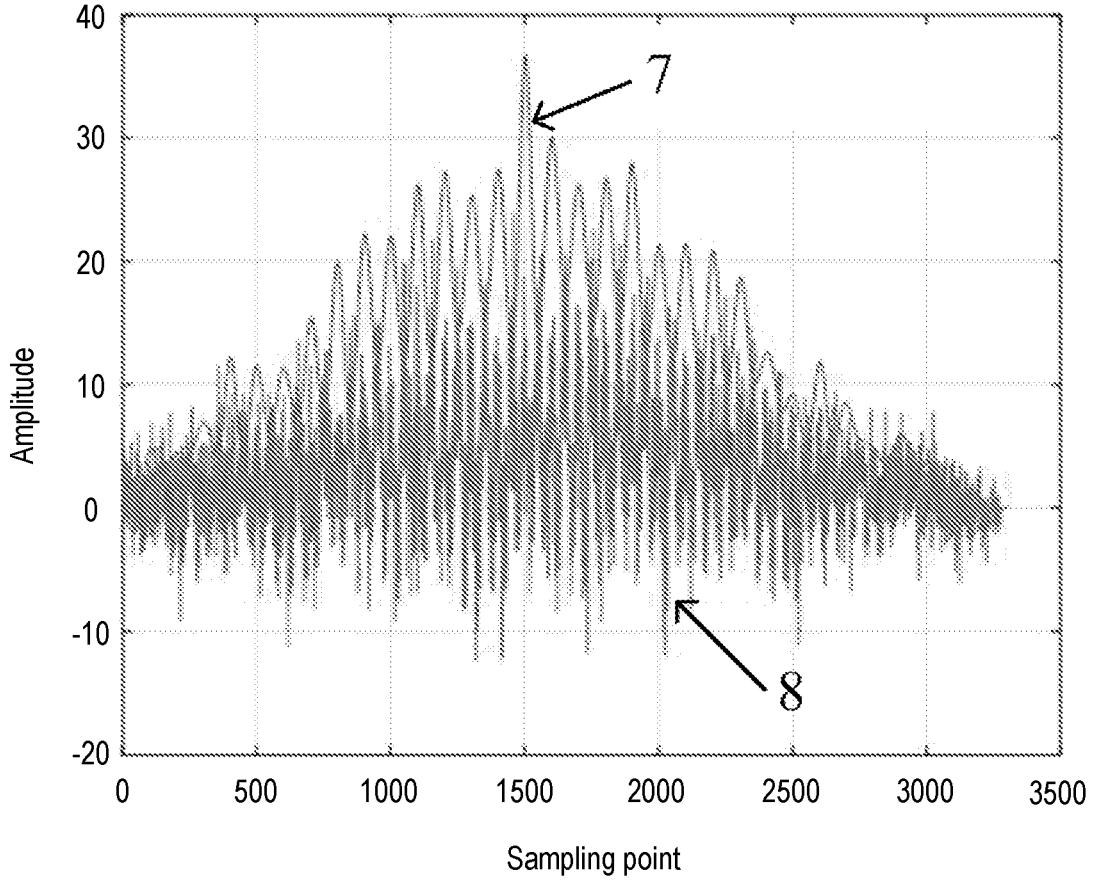
FIG. 7 is a graph comparing curves of the FSK modulated training sequence waveforms respectively related to the synchronous training sequence local waveforms subjected to OOK modulation and FSK modulation when SNR is 1 dB.

It can be seen from FIG. 7 that when Gaussian white noise is added to the synchronous training sequence waveform subjected to the FSK modulation sent downhole, and when SNR is 1 dB, the main peak of the correlation curve (curve 7) when the OOK modulated waveform is used uphole as the local waveform is sharp, while the correlation curve (curve 8) when the FSK modulated waveform is used uphole as the local waveform has no obvious peak. At this time, the output of the synchronous sampling point of the former is 1503, the output of the synchronous sampling point of the latter is 1457, and the errors are 2 sampling points and 44 sampling points, respectively, i.e., 2 ms and 43 ms. In this case, the local waveform of the synchronous training sequence modulated by FSK will be mis-synchronized to the sub-peak of the correlation curve, resulting in a synchronization error of 0.5 code element periods so as to cause an increased bit error rate of the whole data frame. Therefore, in practical applications, the present invention greatly improves the synchronization accuracy of the MWD mud pulse telemetry system on the basis of FSK modulation, thereby solving the problem of increased bit error rate due to the synchronization in the original system.

Step S4, find a synchronous position according to the peak of the correlation curve.

Specifically, the position of the peak in the correlation curve is taken as the result of the synchronization output. In a specific implementation, a sampling point corresponding to the amplitude maximum value of curve 1 in FIG. 3 is calculated as the synchronization point when there is no noise; the sampling point corresponding to the amplitude maximum value of curve 3 in FIG. 4 is calculated as the synchronization point when SNR is 1 dB.

Furthermore, considering the complex downhole conditions, new waveforms should be avoided to increase the difficulty of electric motor control in the MWD mud pulse telemetry system. In a specific implementation of the present invention, in order to avoid generating a new waveform, synchronous training codewords and data subjected to the OOK modulation are sent downhole, and local waveforms of an FSK modulation are used uphole; or the synchronous training codewords and data subjected to FSK modulation are sent downhole, and the local waveforms of OOK modulation are used uphole.

Further, in the MWD mud continuous wave telemetry system, due to the low data transmission rate (the maximum data rate is 40 bps, 12 bps is often used), the present invention also uses the synchronous training sequence as a usage for the fixed codeword for equalizer learning in order to conserve transmission resources.

In order to meet the above two requirements of reducing the difficulty of electric motor control and saving transmission resources, the effect of sending synchronous training codeword modulated by FSK and the synchronous utilization of local waveform modulated by OOK is better, i.e., the synchronous training codeword waveform modulated by FSK is sent downhole and the local waveform modulated by OOK is used uphole for synchronization.

In the downhole, a shear valve sends an FSK modulated synchronous training sequence waveform. In the uphole, the received FSK-modulated synchronous training sequence waveform is subjected to a correlated operation by using the OOK modulated synchronous training sequence local waveform. According to the orthogonality of the trigonometric function, the present invention still retains the excellent synchronization performance of the synchronous training sequence under the local OOK modulation, namely: the correlation peak is sharp; the sub-peak interference is low. Compared with the original FSK modulation system, the present invention has improved the synchronization accuracy and synchronization anti-interference performance.

The synchronization method for the MWD mud pulse telemetry system provided by an embodiment of the present invention improves the synchronization accuracy and synchronization anti-interference performance compared with the original FSK modulation system, and solves the bit error problem caused by the poor synchronization accuracy of the MWD mud continuous wave telemetry system based on FSK modulation; in addition, the electric motor control difficulty downhole is not increased; at the same time, the present invention supports the function of the synchronous training sequence as a fixed codeword for an equalizer to learn, and saves transmission resources of the MWD mud continuous wave telemetry system; furthermore, the synchronous training sequence involved in the present invention is applicable to both OOK and FSK modulation systems at the same time, and when a synchronous training codeword is sent by using FSK modulation, a local waveform of the synchronous training codeword modulated by OOK is used uphole; when the OOK modulation is used to send the synchronous training codeword, the FSK modulated synchronous training sequence local waveform is used uphole.

Further, prior to the synchronization, the method further comprises: the steps of downhole coding and modulation, mud continuous wave channel attenuation and interference on a useful signal, uphole denoising, and uphole matched filtering which are implemented in sequence.

In the downhole, the MWD mud continuous wave system is mainly composed of continuous wave generator, electric motor drive circuit, attitude measurement probe, downhole central control unit, power supply, and like modules. In the uphole, the system is mainly composed of ground sensor, ground data processing unit, coding unit, control unit, and other modules. The downhole part controls the mud (drilling fluid) pressure to generate the expected waveform, which is transmitted to the uphole through the mud, and the uphole carries out data processing on the waveform received by a pressure sensor, then decodes and restores the waveform to the data. This process can be simplified as the MWD mud continuous wave telemetry system communication model.

Specifically, during the downhole encoding and modulation process, the downhole part of the MWD mud continuous wave system controls the electric motor to rotate a rotor in accordance with the protocol conventions of the coding scheme, frame structure, modulation mode, data rate, etc. so that the mud flow between the rotor and the stator changes regularly, ultimately reflecting on the change of the mud pressure wave. In the present invention, the synchronous training codeword in the frame structure may use either FSK modulation or OOK modulation. In this embodiment, a synchronous training codeword on the basis of FSK modulation is sent downhole.

In the process that the mud continuous wave channel attenuates and interferes with the useful signal, and in the MWD mud pulse telemetry system, the attenuation of the useful signal amplitude increases rapidly with the raise of the well depth. The attenuation belongs to frequency selective fading. Channel fading is related to the elastic properties of a drill pipe, the friction between particles in the mud, the coefficient of compressibility of the mud, etc. Due to the influence of channel fading, the useful signal received by an uphole pressure sensor will be distorted and needs to be eliminated by means of an equalizer, etc. uphole. The MWD mud pulse telemetry system is mainly affected by pump noise, bit reflection, motor noise and other interferences, so that digital signal processing is needed uphole to reduce the influence of the interference on the useful signal interpretation, so as to obtain the downhole data correctly.

In the process of uphole de-noising, the MWD mud pulse telemetry system uses the technology of data signal processing to process the mud pressure wave signal collected by a sensor to eliminate the influence of the pump noise and motor noise on the system. In the present embodiment, a denoising mode of generating an analog pump noise waveform by learning a pump noise period through a pump stroke sensor and subtracting the analog pump noise waveform from the received waveform is employed.

In the process of uphole matched filtering, matched filtering is performed in two channels, the first channel processes data according to the waveform of the first local carrier frequency, the second channel processes data according to the waveform of the second local carrier frequency, and then the output waveforms are superimposed to obtain the final result.

After the step of uphole matched filtering, an uphole synchronization step is executed, and correlation processing is performed on the denoised data via the local waveform of the synchronous training sequence (specifically referring to the above-mentioned steps S1-S3). In the present embodiment, when FSK modulation is used for synchronous training codeword sending, a synchronous training sequence local waveform modulated by OOK is used uphole; when the OOK modulation is used for synchronous training codeword sending, the FSK modulated synchronous training sequence local waveform is used uphole.

Still further, after, by means of the irrelevance of the trigonometric function, constructing a correlation between the downhole sending synchronous training sequence waveform and the uphole synchronous training sequence local waveform and performing synchronization, the method further comprises: the steps of uphole equalization, uphole demodulation, and decoding which are implemented sequentially.

In the uphole equalization process, an equalizer is trained with a fixed codeword to obtain an equalization coefficient for use in data decoding. The equalizer may be implemented by using a filter that corrects and compensates for channel-generated characteristics (including, but not limited to, time domain characteristics, frequency domain characteristics, etc.) by adjusting the parameters of the filter to reduce intersymbol interference. Specifically, a linear equalizer or a non-linear equalizer may be used for the implementation. This embodiment is implemented by using a decision feedback equalizer and a decision feedback equalizer coefficient is adjusted through RLS (Recursive Least Squares) or LMS (Least Mean Squares) algorithms to achieve adaptive equalization. Furthermore, in order to improve the data transmission efficiency of the MWD mud pulse telemetry system, equalizer training can be performed by using the synchronous training codeword. At this time, the FSK synchronous training codeword needs to be sent downhole, and the local waveform of the synchronous training sequence is modulated by the OOK uphole to perform the synchronization.

In the process of uphole demodulation and decoding, demodulating is performed by means of coherent demodulation or non-coherent demodulation, etc. then a 01 codeword is obtained through the decision, and then according to a coding scheme agreed by the protocol (for example, it may include: error correction of coding, check bits, etc.), and frame structure composition, a corresponding parameter value is obtained. This embodiment uses the decoded mode of coherent demodulation and hard decision.

A synchronization method for the MWD mud pulse telemetry system provided by an embodiment of the present invention constructs a synchronous training sequence, and, on the basis of the synchronization sequence, proposes a synchronization method compatible with modulation process of FSK modulation and OOK modulation; constructing a correlation between the downhole sending synchronous training sequence waveform and the uphole synchronous training sequence local waveform by means of the irrelevance of the trigonometric function is performed such that the uphole and downhole synchronization of the FSK modulation is completed and such that the correlation peak of the synchronous training sequence increases and the difference between the main peak and the sub-peak increases; the present invention improves the synchronization accuracy and reliability of the MWD mud pulse telemetry system without increasing the complexity of the electric motor control of the MWD mud pulse telemetry system; at the same time, the synchronous training sequence can also be used for equalizer training of an MWD mud continuous wave system so as to save transmission resources of the system.

So far, various embodiments of the present disclosure have been described in detail. To avoid shielding the concept of the present disclosure, some details known in the art are not described. From the above description, those skilled in the art could fully understand how to implement the technical solutions disclosed herein.

While some specific embodiments of the disclosure have been described in detail by way of examples, it should be understood by those skilled in the art that the foregoing examples are illustrative only and are not intended to limit the scope of the disclosure. It should be understood by those skilled in the art that the above embodiments can be modified or some technical features can be equivalently replaced without departing from the scope and spirit of the present disclosure. The scope of the present disclosure is defined by the appended claims.

What is claimed is:

1. A synchronization method for a measurement while drilling (MWD) mud pulse telemetry system, characterized by comprising steps below:

determining a synchronous training sequence on a basis of a frame structure of downhole sent data;

constructing a correlation between a downhole sending synchronous training sequence waveform and an uphole synchronous training sequence local waveform by means of an irrelevance of a trigonometric function;

performing, uphole, correlation calculation on a received synchronous training sequence waveform which is subjected to a first modulation and the synchronous training sequence local waveform which is subjected to a second modulation, so as to obtain a correlation curve; and finding a synchronous position according to a peak of the correlation curve.

2. The synchronization method for an MWD mud pulse telemetry system according to claim 1, wherein the determining the synchronous training sequence on the basis of the frame structure of the downhole sent data comprises:

determining the frame structure of the downhole sent data;

determining the synchronous training sequence according to the frame structure of the downhole sent data; and sending the synchronous training sequence waveform subjected to the first modulation through a shear valve.

3. The synchronization method for an MWD mud pulse telemetry system according to claim 1, wherein the performing, uphole, the correlation calculation on the received synchronous training sequence waveform which is subjected to the first modulation and the synchronous training sequence local waveform which is subjected to the second modulation, so as to obtain the correlation curve comprises:

sending the synchronous training sequence waveform subjected to the first modulation through a shear valve; and collecting, uphole, the received synchronous training sequence waveform subjected to the first modulation via a pressure sensor and performing the correlation calculation on the same with the synchronous training sequence local waveform subjected to the second modulation so as to obtain the correlation curve.

4. The synchronization method for an MWD mud pulse telemetry system according to claim 1, wherein the constructing the correlation between the downhole sending synchronous training sequence waveform and the uphole synchronous training sequence local waveform by means of the irrelevance of the trigonometric function comprises:

sending frequency-shift keying (FSK) modulated synchronous training codeword waveform downhole and using on-off keying (OOK) modulated local waveform uphole.

5. The synchronization method for an MWD mud pulse telemetry system according to claim 1, wherein the constructing the correlation between the downhole sending synchronous training sequence waveform and the uphole synchronous training sequence local waveform by means of the irrelevance of the trigonometric function comprises:

sending on-off keying (OOK) modulated synchronous training codeword waveform downhole and using frequency-shift keying (FSK) modulated local waveform uphole.

6. The synchronization method for an MWD mud pulse telemetry system according to claim 1, wherein the finding the synchronous position according to the peak of the correlation curve comprises:

taking a peak position in the correlation curve as a result of synchronization output.

7. The synchronization method for an MWD mud pulse telemetry system according to claim 1, wherein prior to synchronization, the method further comprises:

steps of downhole coding and modulation, mud continuous wave channel attenuation and interference on a useful signal, uphole denoising, and uphole matched filtering which are implemented in sequence.

8. The synchronization method for an MWD mud pulse telemetry system according to claim 1, wherein after the constructing the correlation between the downhole sending synchronous training sequence waveform and the uphole synchronous training sequence local waveform by means of the irrelevance of the trigonometric function, the method further comprises:

steps of uphole equalization and uphole demodulation and decoding which are implemented in sequence.

* * * * *